US007258204B2

(12) United States Patent
Kurzo

(10) Patent No.: US 7,258,204 B2
(45) Date of Patent: Aug. 21, 2007

(54) GUIDE DEVICE FOR GUIDANCE OF A LOAD CARRIER OF AN ELEVATOR INSTALLATION

(75) Inventor: Yvan Kurzo, Luzern (CH)

(73) Assignee: Inventio AG, Hergiswil, NW (CH)

( * ) Notice: Subject to any disclaimer, the term of this patent is extended or adjusted under 35 U.S.C. 154(b) by 120 days.

(21) Appl. No.: 10/834,511

(22) Filed: Apr. 29, 2004

(65) Prior Publication Data

US 2004/0251089 A1 Dec. 16, 2004

(30) Foreign Application Priority Data

Apr. 29, 2003 (EP) ..... 03405298

(51) Int. Cl.
*B66B 7/08* (2006.01)

(52) U.S. Cl. ..... 187/411; 187/409

(58) Field of Classification Search ..... 187/409, 187/406, 410, 411

See application file for complete search history.

(56) References Cited

U.S. PATENT DOCUMENTS 1,916,365 A 7/1933 Dunlop
3,856,117 A * 12/1974 Solymos ..... 187/406
5,033,589 A * 7/1991 Rhodes ..... 187/410
5,632,358 A * 5/1997 Maeda et al. ..... 187/410
6,050,370 A * 4/2000 Jung ..... 187/410

FOREIGN PATENT DOCUMENTS

EP 0 033 184 8/1991
GB 787386 12/1957

* cited by examiner

*Primary Examiner*—Gene C. Crawford
*Assistant Examiner*—Terrell Matthews
(74) *Attorney, Agent, or Firm*—Fraser Clemens Martin & Miller LLC; William J. Clemens

(57) ABSTRACT

A guide device guides a load carrier of an elevator installation along a guide surface and comprises a guide element contacting the guide surface and connected by a connecting element with the load carrier such that the guide element is movable relative to the load carrier in a first and/or a second positional range. The connecting element comprises first and second resilient elements in a serial arrangement, wherein movement of the guide element in the first range deforms both resilient elements and movement of the guide element in the second range exclusively deforms the second resilient element. The overall stiffness of the connecting element is a function of the respective position of the guide element. Stiffness of the second resilient element increases during compression in the second range, wherein the overall stiffness is substantially constant at a transition between the first and the second ranges.

19 Claims, 5 Drawing Sheets

GUIDE DEVICE FOR GUIDANCE OF A LOAD CARRIER OF AN ELEVATOR INSTALLATION

BACKGROUND OF THE INVENTION

The present invention relates to a guide device for the guidance of a load carrier of an elevator installation along at least one guide surface.

By the term 'load carrier' there are to be understood in this connection all movable masses which can be moved in an elevator installation along a guide surface. Falling under this term are, in particular, elevator cars and counterweights. The latter serve in an elevator installation for compensation for the weight of other load carriers.

A guide device of the stated kind is used in elevator systems in order to stabilize the position of a load carrier movable along a guide surface. Such a guide device usually comprises at least one guide element which is disposed in contact with the guide surface and is connected with the load carrier by means of a connecting element in such a manner that the guide element is movable relative to the load carrier or the load carrier is movable relative to the guide element.

In a typical realization of the guide device, the respective guide surface can be defined by, for example, the surface of a guide rail and a roller can be used in each instance as a guide element and a resiliently deformable structure, which connects a rotational axle of the roller with the respective load carrier, in each instance as a connecting element. The connecting element can be, for example, a spring or an arrangement of several springs. In addition, several guide surfaces and correspondingly several guide elements can be used for guidance of the respective load carrier.

Connecting elements which allow a resilient deformation in the case of a mechanical load offer the possibility of connecting a guide element with a load carrier in such a manner, and in each instance keeping it in contact with a guide surface, such that the respective connecting element is deformed to a predetermined extent by comparison with a relaxed state and thus has a predetermined bias. By virtue of the bias, each guide element exerts a force on the respective guide surface. Such connecting elements are used in order to stabilize the load carrier in its equilibrium position with respect to the guide surface. If the respective connecting element is deformed in the case of deflection of the load carrier out of the equilibrium position, then there results therefrom a restoring force which acts on the load carrier and the size of which grows with increasing deflection of the load carrier out of the equilibrium position and thus opposes the deflection. It is thus ensured that the load carrier adopts an equilibrium position with respect to the respective guide surface when the guide element is constantly in contact with the respective guide surface.

The respective connecting element substantially determines the travel behavior of a load carrier moved along a guide surface. The stiffness of the connecting element is of particular significance in that case. The stiffness of the connecting element is a measure for a change in the force which has to be realized in order to change the position of the respective guide element by a predetermined distance.

The stiffness of a connecting element plays a significant role with respect to the travel comfort particularly in the case of a guide device for guidance of an elevator car. The connecting elements have to be so constructed in every case that they absorb the maximum permissible disturbance forces and keep a deviation of the load carrier from a predetermined equilibrium position within a predetermined limit. Different requirements have to be taken into consideration in the design of a connecting element with respect to stiffness. If the stiffness is too great, the elevator car has a hard coupling to the respective guide surface by way of a connecting element and the corresponding guide element. In this case during travel of the elevator car disturbing forces due to non-rectilinearities of a guide surface or load displacements lead to severe shocks which would be perceived by passengers to be unacceptable. If—at the other extreme—the stiffness is too low, then small deflections of the elevator car from the equilibrium position would indeed be sensed by passengers as less disturbing. On the other hand, large disturbing forces would lead to unacceptably large deflections of the elevator car from the equilibrium position. The latter is problematic, since only a limited space is available for lateral deflections of a elevator car perpendicularly to its direction of movement and, in addition, the connecting elements for constructional reasons—in order to avoid a mechanical contact between stationary and moved components of the elevator installation and damage of individual parts—allow only a limited play for relative movement of a guide element with respect to the elevator car. For example, the movement of the elevator car relative to a guide device is limited by the construction of a safety brake device, which the elevator car has to have in order to brake the elevator car at guide surfaces of the guide rail in the case of emergency and to stop it. During normal travel the elevator car may, in fact, deflect only so far from an equilibrium position with respect to the guide surfaces that the safety brake device does not come into contact with the guide surfaces.

Known connecting elements which act by a single spring on a guide element have a stiffness which is intrinsic to construction and which is usually constant for all positions of the guide element. With a connecting element which has a constant stiffness, however, the requirements which have to be fulfilled in operation of an elevator installation cannot be fulfilled or are able to be fulfilled only insufficiently. In the best cases, compromise solutions are possible which are unsatisfactory with respect to usual expectations, particularly with respect to the extreme requirements imposed in the case of applications in high-speed elevators.

With the speeds at which high-speed elevators are operated even slight unevennesses of guide surfaces lead to large transverse forces. In order to ensure, in operation, an acceptable travel comfort even in the case of large transverse forces, guide devices were proposed with a respective connecting element having a stiffness which is variable in dependence on the setting of the guide element relative to the respective load carrier.

For example, there is shown in European patent EP 0 033 184 a guide device for a load carrier of an elevator installation in which at least one guide element is disposed in contact with the guide surface and is connected by means of a connecting element with the load carrier in such a manner that the guide element is movable relative to the load carrier between different positions in a first and a second positional range. The connecting element comprises a first and a second resilient element in the form of a first and a second helical spring. The helical springs are arranged in series in such a manner that in the case of movement of the guide element in the first positional range the two helical springs are deformed in the direction of their longitudinal extent. A change in length of the first helical spring is mechanically limited in such a manner that in the case of movement of the guide element in the second positional range exclusively the second resilient element is deformed. The two helical springs each have a constant stiffness, wherein the stiffness of the second helical spring is greater than the stiffness of the first helical spring. This results in an overall stiffness of the connecting element which is determined by the respective stiffnesses of the first and second helical springs and is a function of the respective position of the guide element. The overall stiffness adopts higher values in the second positional range than in the first positional range. In this construction of the connecting element the overall stiffness of the connecting element is constant each time not only in the first positional range, but also in the second positional range. With this construction of the connecting element it is indeed possible, through appropriate specifications for the stiffnesses of the first and the second helical spring, to softly couple the guide element to the guide surface when the guide element is disposed in the first positional range and to firmly couple it to the guide surface when the guide element is disposed in the second positional range. However, in the case of transition of the guide element from the first positional range to the second positional range an abrupt transition from soft to hard coupling to the guide surface takes place. The overall stiffness of the connecting element accordingly has a non-constant jump at the transition of the guide element between the first positional range and the second positional range. This abrupt transition is in operation more disturbing the greater the difference between the stiffnesses of the two helical springs. Since each connecting element accepts the maximum permissible disturbing forces and has to keep deviation of the load carrier from a predetermined equilibrium position within a predetermined limit, the stiffness of the second helical spring must be selected to be greater the smaller the stiffness of the first helical spring. Accordingly, an improved travel comfort in the case of small deflections of the load carrier from its equilibrium position is achieved and in that case a diminished travel comfort in the region of the transition between the first and the second positional range is taken into account.

SUMMARY OF THE INVENTION

The present invention has an object of creating a guide device for guidance of a load carrier of an elevator installation, and an elevator installation, which enable improved travel comfort.

The guide device according to the present invention comprises at least one guide element which is disposed in contact with a guide surface and which is connected by means of a connecting element with the load carrier in such a manner that the guide element is movable relative to the load carrier between different positions in a first and a second positional range, wherein the connecting element comprises a first and a second resilient element. The resilient elements are arranged in series in such a manner that in the case of movement of the guide element in a first positional range the two resilient elements are deformed and in the case of movement of the guide element in the second positional range exclusively the second resilient element is deformed. Since the guide element is disposed in contact with the guide surface, there is produced by the deformation of the resilient elements a force which acts on the guide element and is directed to the guide surface and the size of which is dependent on the respective position of the guide element. In that case it is assumed that an overall stiffness of the connecting element is a function of the respective position of the guide element and the overall stiffness in the second positional range adopts higher values than in the first positional range.

By 'overall stiffness' there is to be understood in this connection the change in the force which acts on the guide element and has to be realized in order to change the position of the guide element by a predetermined distance.

According to the present invention the second resilient element is constructed in such a manner that a stiffness of the second resilient element increases in the case of compression of the element in the second positional range and that the overall stiffness of the connecting element on transition of the guide element between the first and the second positional range has a substantially constant course.

The selection of the two resilient elements, the resilient characteristics of which are to be appropriately matched to one another, is significant for the present invention. Depending on the position of the guide element, the first and the second resilient elements are respectively deformed to different extents. The force acting on the guide element varies in correspondence with the degree of deformation of the respective resilient element. In the first positional range of the guide element the force which the guide element exerts on the contact surface is determined by the first and the second resilient elements, since the two resilient elements are arranged in series and in the case of movement of the guide element in this positional range both resilient elements are deformed. In the second positional range of the guide element the force which the guide element exerts on the guide surface is determined in dependence on the instantaneous position of the guide element exclusively by the second resilient element, since during movement of the guide element in the second positional range exclusively the second resilient element is deformed. Due to the fact that the stiffness of the second resilient element increases in the case of compression of this element in the second positional range, a force can be exerted on the guide element in the second positional range which exhibits a progressive behavior, i.e. increases non-linearly, when the guide element is so moved relative to the load carrier that the second resilient element is placed under compression to increasing extent.

The progressive behavior is advantageous in two respects. On the one hand, in the case of strong compression of the second resilient element in the second positional range a relatively large force can be exerted on the guide element, wherein the stiffness of the second resilient element is relatively large and thus a relatively hard coupling of the guide element to the guide surface is realized. On the other hand, the stiffness of the second resilient element during movement of the guide element in the second positional range in direction towards the first positional range decreases with increasing compression of the second resilient element. Under this condition, the first resilient element can have a relative low stiffness and co-operate with the second resilient element in such a manner that the overall stiffness of the connecting element on transition of the guide element from the first positional range to the second positional range exhibits a substantially steady course. In the ideal case the resilient characteristics of the first and the second resilient element can be matched to one another in such a manner that the overall stiffness of the connecting element does not have a jump on the transition of the guide element between the first positional range and the second positional range. On this basis an improved travel comfort is realized.

Production tolerances or inhomogeneities of the available materials can have the consequence that the overall stiffness of the connecting element nevertheless exhibits a small jump on transition of the guide element between the first positional range and the second positional range. Existing technologies, however, make it possible to keep such a jump small relative to the maximum change which the overall stiffness of the connecting element can accept on movement of the guide element between desired positions in the first and/or second positional range. Jumps, which are minimized in that manner, in the overall stiffness in dependence on the position of the guide element are tolerable with respect to travel comfort.

A solid body, which has a stiffness increasing with compression in the case of compressing, is, for example, suitable as second resilient element. The stiffness of a resilient element constructed in that manner can be selectively influenced solely by selection of the external dimensions. This opens up a simple approach of adapting the characteristics of the second resilient element to the characteristics of a predetermined first resilient element in order, in accordance with the invention, to realize the substantially constant course of the overall stiffness of the connecting element on transition of the guide element between the first and second positional range. The second resilient element could, for example, be a solid body in the form of a cylinder or a block or another three-dimensional shape. The outer dimensions of the second resilient body of that kind are a magnitude, which can be controlled in simple manner, and usually have an influence, which can be calculated by simple methods, on the resilient characteristics of the element, particularly on the size of the force which has to be applied for deformation of the element by a predetermined amount. This simplifies costs in the construction of guide devices which have to be specifically optimized with respect to different requirements, for example with respect to compensation for transverse forces which can act on a load carrier transversely to the guide surfaces when the load carrier is moved along the guide surfaces. The magnitude of the transverse forces varies over a large range in dependence on a number of parameters of an elevator installation, for example on the mass, external dimensions and travel speed of the load carrier. According to the aforesaid concept an existing design of a guide device can be optimally adapted in simple manner to other operating conditions or be matched to another construction of an elevator installation, since, inter alia, merely the dimensions of the second resilient element have to be modified in order to suitably vary the resilient characteristics of the second resilient element and in this manner to respectively optimize the guide device depending on the construction and the operating conditions of the elevator installation.

In a further form of embodiment of the guide device it is provided that the resilient elements are biased when the guide element adopts a normal setting with respect to the load carrier. By the term 'normal setting' there is understood in this connection the setting of a guide element relative to the load carrier for the case that the load carrier adopts an equilibrium position relative to the guide surfaces, i.e. that no force acts on the load carrier which produces a change in the spacing between the load carrier and one of the guide surfaces. The bias of the resilient elements in that case ensures that the guide element in the case of deviation of the load carrier from the equilibrium position remains in contact with the guide surface. It is to be regarded as an additional advantage of this variant that the bias can be utilized as an additional parameter for optimization. With the bias, the resilient characteristics of a number of suitable materials, from which the resilient elements can be made, can be varied in order to appropriately influence the overall stiffness of the connecting element.

The second resilient element could be, for example, a solid body made of an elastomer. Elastomers from the family of polyurethanes, particularly cellular or mixed-cellular polyurethanes, for example, form a suitable class of substance. The resilient characteristics of such elastomers vary—for example, in dependence on the density and a predetermined bias—over a comparatively large parameter range. The stiffness of cellular or mixed-cellular polyurethane elastomers usually increases, for example, with increasing density and increasing compression. In particular, the stiffness usually increases in an extremely non-linear manner above a compression of approximately 30% with increasing compressing. Depending on the respective density of the polyurethane material, the stiffness in the case of low compression of less than 30% can also decrease with increasing compressing. If the second resilient element is made of an elastomer of that kind then a relatively large parameter range is available in order to adapt the resilient characteristics of the second resilient element to the resilient characteristics of a first resilient element, which together with the second resilient element forms a connecting element in the sense of the present invention.

The stiffness of the first resilient element can be constant. In order to achieve a constant stiffness, the resilient element can be formed by a spring, for example a helical spring.

In order to achieve that the first resilient element is deformed substantially only when the guide element adopts a position in the first positional range, various options can be selected. For example, one or more limiter elements can be used in order to limit a deformation of the first resilient element to a predetermined amount in the case of movement of the guide element relative to the load carrier. In particular, limiter elements of that kind can be arranged in such a manner that the first resilient element deforms only when the guide element is disposed in the first positional range and is subjected to no further deformation when the guide element moves in the second positional range. Resilient elements, the compression of which is restricted to a predetermined amount on the basis of the shape of the resilient element itself, form a further option. Coming into this category are, for example, structures, which are deformable by bending, consisting of structural elements which in the case of compression of the structure are moved relative to one another and in the case of a specific amount of compression hit against one another and thus prevent further compression of the structure beyond this amount. The latter option is realized by, for example, a helical spring: this can be compressed in its longitudinal direction only to a minimum length, which results from the number of coils of the spring and the thickness of each coil.

A further development of the guide device comprises a plurality of the guide element and of the connecting element, wherein in each instance two of the guide elements together with the respective connecting elements are arranged in such a manner that the guide elements are disposed in contact with a guide surface and the respective connecting elements are biased in opposite direction. A paired arrangement of guide elements in that manner with connecting elements biased in opposite direction enables stabilization of the load carrier in an equilibrium position against deflections of the load carrier from this equilibrium position in a direction perpendicular to the guide surface. In the case of a deflection of that kind, in each instance one connecting element opposes the deflection whilst the other connecting element due to the bias of the guide element connected therewith remains in contact with the guide surface. In addition, the bias can be used for fine tuning the resilient characteristics of the second resilient element if, for example, the stiffness of the second resilient element is a function of the bias.

In a variant of this development of the guide device the connecting elements are biased in a normal setting relative to the load carrier in such a manner that the guide elements in each instance adopt a position in the respective second positional range. In this case, on deflection of the load carrier out of its equilibrium position with respect to the guide surfaces the restoring forces are applied exclusively by one of the second resilient elements. This variant is particularly advantageous when the stiffness of the second resilient element initially decreases to a minimum value with increasing compression and non-linearly increases with further increasing compression. In this case the bias ensures a fine tuning of the resilient characteristics of the second element. In this manner it is possible to realize a restoring force which increases in non-linear manner with increasing deflection, wherein the stiffness of the connecting element—caused by the characteristics of the second resilient element—is particularly low in the case of small deflections. The bias accordingly also serves for optimization of travel comfort.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
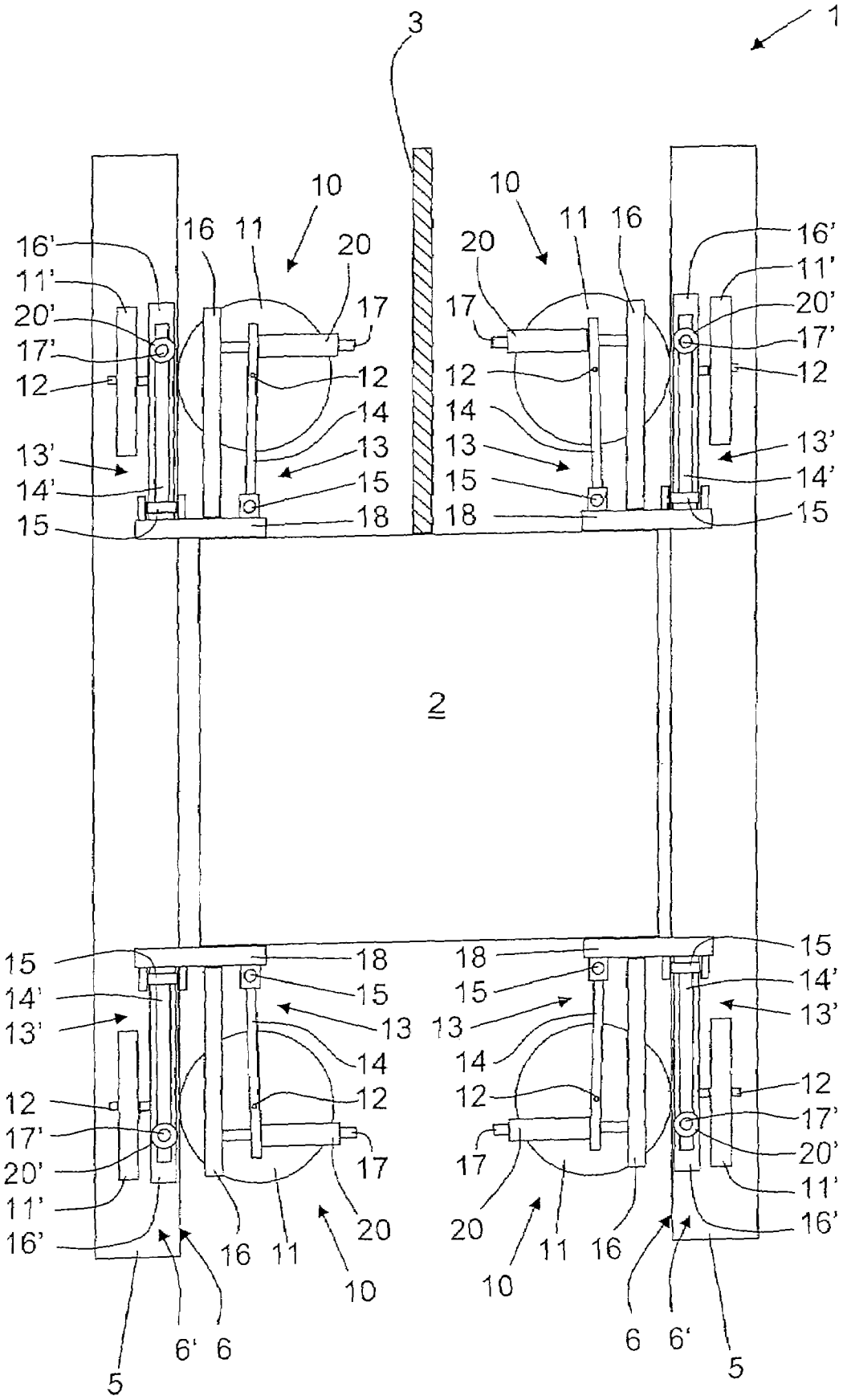
FIG. 1 is a schematic side elevation view of a portion of an elevator installation with a load carrier and with several guide devices according to the present invention.
Figure 2:
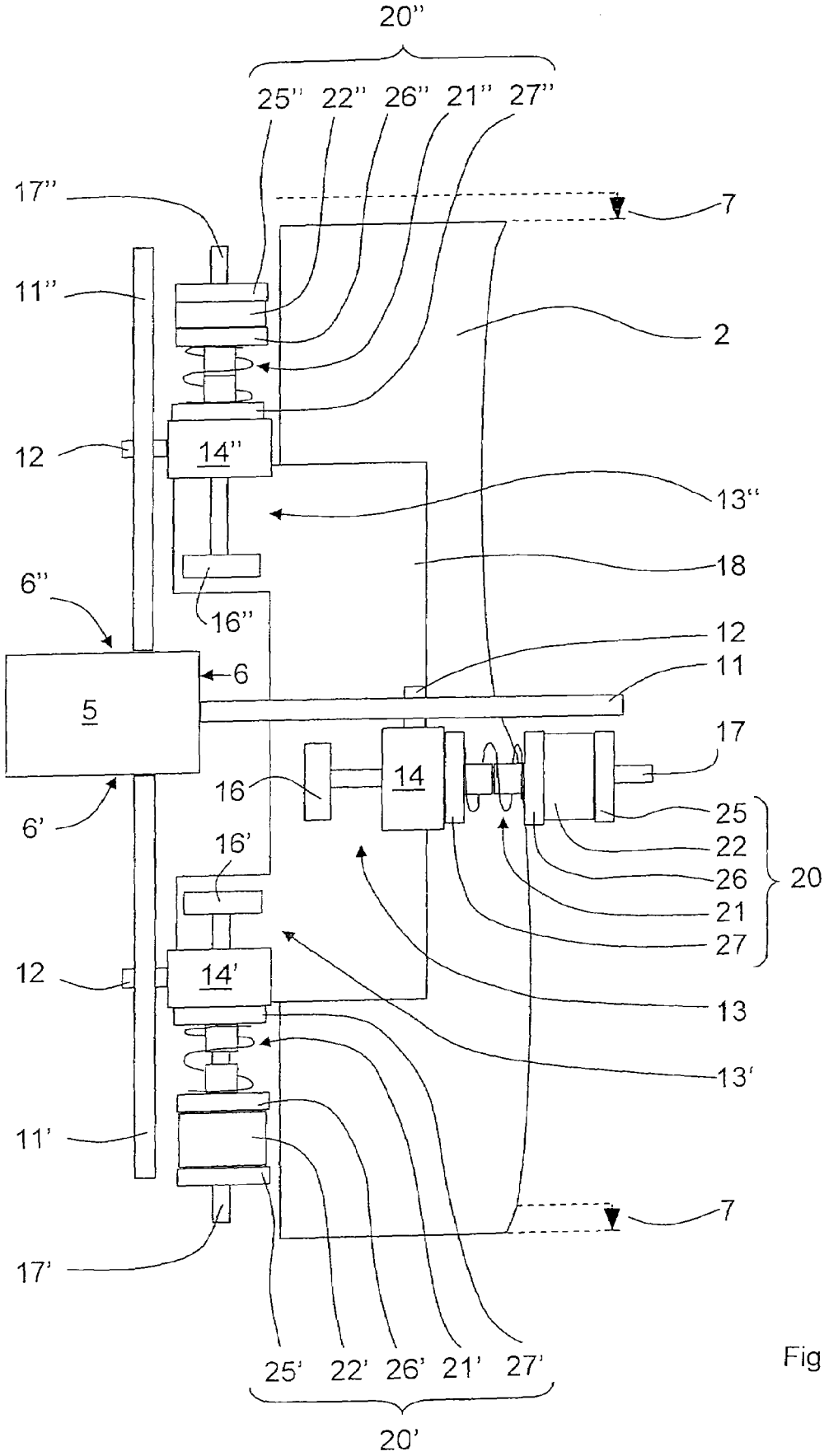
FIG. 2 is a schematic plan view of one of the guide devices shown in FIG. 1, with three guides and connecting elements in detail.

FIG. 1 shows, in a side view of a portion of an elevator installation 1, a load carrier 2, such as an elevator car, which hangs at a cable 3 and is movable along two guide rails 5. As is indicated in FIG. 2, each guide rail 5 has respective guide surfaces 6, 6' and 6", wherein the guide surfaces 6' and 6" each extend parallel to one another and are each arranged perpendicularly to the guide surface 6. In order to guide the load carrier 2 in the case of movement along the guide rails 5, four guide devices 10 are provided, which are each fastened to the load carrier 2. Each of the guide devices 10 comprises guide elements 11, 11' and 11", a support 13, 13' and 13" for each of the guide elements 11, 11' and 11" respectively and an associated base plate 18. The base plates 18 are fastened to the load carrier 2. The supports 13, 13' and 13" are in that case each connected with a respective one of the base plates 18 and support the guide elements 11, 11' and 11" in such a manner that these are disposed in contact with one of the guide surfaces 6, 6' and 6". In the present case, each of the guide elements 11, 11' and 11" is formed as a roller which has a respective rotational axle 12 mounted in one of the supports 13, 13' and 13" and which rolls along a respective one of the guide surfaces 6, 6' and 6" when the load carrier 2 moves along the guide rails 5. For guidance of the load carrier 2 along one of the guide rails 5 there are provided each time two guide devices 10 which are respectively arranged at a spacing from one another in the direction of the respective guide rail 5.

Each of the supports 13, 13' and 13" is constructed in such a manner that the load carrier 2 is movable in a plane transverse to the guide surfaces 6, 6' and 6" relative to the guide elements 11, 11' and 11". The respective movement play in that case is established by constructional details of the supports 13, 13' and 13". Each of the supports 13, 13' and 13" comprises a lever 14, 14' or 14" which each comprises a bearing for one of the rotational axles 12, a rotational bearing 15 for the respective lever 14, 14' or 14", a respective support 16, 16' or 16", a respective connecting element 20, 20' or 20" and a respective guide 17, 17' or 17" for each of the connecting elements 20, 20' and 20". Each of the supports 16, 16' and 16" is in that case fixedly connected with a respective one of the base plates 18 and forms a stable reference for one of the levers 14, 14' and 14".

The profiles of the connecting elements 20, 20' and 20" are indicated in FIG. 1 merely schematically without reference to constructional details. The latter are explained in the following in connection with FIGS. 2 and 3A-C.

The support 16, the lever 14, the rotational bearing 15, the guide 17 and the connecting element 20 co-operate in each instance as follows. The lever 14 can be pivoted about the rotational bearing 15 and along the guide 17 and accordingly can adopt different positions relative to the support 16 and thus relative to the load carrier 2. The guide 17 is fixedly connected with the support 16. The connecting element 20 is resiliently deformable in a manner still to be explained in connection with FIGS. 2 and 3A-C and produces a connection between the lever 14 and an end region of the guide 17. If the lever 14 is moved in direction towards the end of the guide 17 remote from the support 16, the connecting element 20 is resiliently deformed and produces a force which opposes movement of the lever.

The supports 16' and 16", the levers 14' and 14", the guides 17' and 17" and the connecting elements 20' and 20" co-operate in each instance in corresponding manner as described above.

The guides 17, 17' and 17" are constructed to be rod-shaped in the present example and have the function of keeping under check a deformation, which accompanies a movement of one of the levers 16, 16' and 16", of one of the connecting elements 20, 20' and 20".

In the elevator installation 1 according to FIG. 1, each of the supports 13, 13' and 13" co-operates with a guide element 11, 11' or 11" in such a manner that in an equilibrium position of the load carrier 2 all of the guide elements 11, 11' and 11" are disposed in contact with one of the guide surfaces 6, 6' and 6" and the respective connecting elements 20, 20' and 20" are biased in such a manner that the guide elements 11, 11' and 11" each exert a force on one of the guide surfaces 6, 6' and 6". In the present case the guide devices 10 are arranged in such a manner that all forces acting on the guide surfaces 6, 6' and 6" are compensated within a plane perpendicular to these guide surfaces when the load carrier 2 is disposed in the equilibrium position. This force equilibrium is disturbed when the load carrier, influenced by disturbing forces acting transversely to the guide surfaces 6, 6' and 6", is moved out of the equilibrium position in a plane perpendicular to the guide surfaces 6, 6' and 6". In this case, the respective connecting elements 20, 20' and 20" are resiliently deformed. Resulting from this deformation are forces which oppose the movement of the load carrier 2.

FIG. 2 shows a portion of the load carrier 2 in a plan view in conjunction with one of the guide rails 5. In the present case it is assumed that the load carrier 2 is instantaneously deflected, under the action of a disturbing force acting perpendicularly to the guide surfaces 6' and 6" and parallel to the guide surface 6, by a distance having a length indicated by an arrow 7. The guide elements 11, 11' and 11" in that case are each disposed in contact with a respective one of the guide surfaces 6, 6' and 6". The latter presupposes that the levers 14, 14' and 14" each adopt a respective position with respect to the supports 16, 16' and 16" and thus relative to the load carrier 2 which is consistent with the deflection of the load carrier 2 out of the equilibrium position.

The levers 14, 14' and 14" each comprise a continuous opening (not illustrated). These openings each serve as passage openings for a respective one of the guides 17, 17' and 17", wherein the levers 14, 14' and 14" are each arranged in such a manner that they are movable without obstruction along the respective guides 17, 17' and 17".

The connecting elements 20, 20' and 20" are each composed of a plurality of individual components which in each instance co-operate in analogous manner.

The connecting element 20 comprises a first resilient element 21 and a second resilient element 22, a counter-bearing 25 and two limiter elements 26 and 27. All of these components of the connecting element 20 are arranged in series along the guide 17 and each have a respective passage opening (not illustrated) for the guide 17. The counter-bearing 25 is in that case fixed to the end of the guide 17 remote from the support 16. The limiter element 27, the first resilient element 21, the limiter element 26 and the second resilient element 22 are arranged in a line in this sequence between the lever 14 and the counter-bearing 25. This sequence is not, however, essential with respect to the function of the connecting element 20. The reverse sequence also comes within the scope of the invention.

The resilient elements 21 and 22 are arranged to be movable along the guide 17 in such a manner that their length along the guide 17 is variable depending upon the respective position of the lever 14 in relation to the counter-bearing 25. In particular, the first resilient element 21 and the second resilient element 22 can each be placed under a compressive stress when the spacing between the lever 14 and the counter-bearing 25—measured along the guide 17—is selected to be shorter than the length which the connecting element 20 adopts along the guide 17 when the resilient elements 21 and 22 are completely relaxed. Correspondingly, the connecting element 20 exerts a force on the lever 14 in direction towards the support 16 when the first resilient element 21 and/or the second resilient element 22 are disposed under a compressive stress.

The limiter elements 26 and 27 have two functions. On the one hand they offer—as is still to be explained in detail in conjunction with FIGS. 3A-C—a respective support surface for the first resilient element 21. Through change in the spacing between the limiter elements 26 and 27 the longitudinal extent of the first resilient element 21 in the direction of the guide 17 can be changed. On the other hand, due to their shape the minimum spacing which the said support surfaces can adopt relative to one another is limited. This limit is reached when the limiter elements 26 and 27 are brought into a setting relative to one another along the guide 17 in which they contact one another (see FIGS. 3A-C). The minimum length extent which the first resilient element 21 can have in the longitudinal direction of the guide 17, and thus also the maximum bias which the first resilient element 21 can absorb by a compression in the longitudinal direction of the guide 17, is thereby fixed.

The connecting elements 20' and 20" have the same construction as the connecting element 20. The connecting element 20' and the connecting element 20" have, in series arrangement along the guide 17' or 17", respectively: a counter-bearing 25' or 25" which is fastened to one end of the guide 17' or the guide 17", respectively, and corresponds with the counter-bearing 25; a first resilient element 21' or 21" which corresponds with the first resilient element 21 of the connecting element 20; a limiter element 26' or 26" which corresponds with the limiter element 26 of the connecting element 20; a limiter element 27' or 27" which corresponds with the limiter element 27 of the connecting element 20; and a second resilient element 22' or 22" which corresponds with the second resilient element 22 of the connecting element 20.

In the following it may be assumed that—if the load carrier in the static state adopts an equilibrium position with respect to the guide surfaces 6, 6' and 6"—the connecting elements 20, 20' and 20" are biased in such a manner that the guide elements 11, 11' and 11" each act with the same force on the respective guide surface.

As already mentioned, the load carrier 2 in the situation illustrated in FIG. 2 is deflected out of its equilibrium position perpendicularly to the guide surfaces 6' and 6" through the spacing characterized by the arrow 7. The setting of the load carrier 2 in the direction perpendicular to the guide surface 6 corresponds in the present case with the equilibrium position. FIG. 2 correspondingly shows the connecting element 2 in a state with which the equilibrium position of the load carrier 2 relative to the guide surface 6 is associated. In the present case, not only the first element 21, but also the second resilient element 22 are placed under a compressive stress, i.e. biased, by a predetermined amount in the longitudinal direction of the guide 17. The limiter elements 26 and 27 contact one another. As mentioned, under this precondition the minimum longitudinal extent which the first resilient element 21 can have in the length direction of the guide 17, and thus the maximum bias which the first resilient element 21 can absorb by a compression in the longitudinal direction of the guide 17, is realized. The bias of the first resilient element 21 and of the second resilient element 22 is so selected that the resilient elements 21 and 22 are placed under a compressive stress in all positions which the load carrier 2 can adopt in operation of the elevator installation 1.

Since the load carrier 2 in the situation illustrated in FIG. 2 is deflected perpendicularly to the guide surfaces 6' and 6" out of its equilibrium position, the connecting elements 20' and 20" are instantaneously transferred into stressed states which differ from the stress state of the connecting element 20. In particular, the instantaneous compressive stress which the connecting element 20" has in longitudinal direction of the guide 17 is greater than the compressive stress under which the connecting element 20 is placed in the direction of the guide 17. Thereagainst, the instantaneous compressive stress which the connecting element 20' has in the longitudinal direction of the guide 17' is smaller than the compressive stress under which the connecting element 20 is placed in the direction of the guide 17. This means that the second resilient element 22' is compressed longitudinally of the guide 17" to a higher extent and the second resilient element 22' is compressed longitudinally of the guide 17' to a lesser extent than the second resilient element 22 longitudinally of the guide 17. In the present case the compressive stress which the second resilient 22" absorbs is greater than the compressive stress which the first resilient element 21" absorbs. In addition, the connecting element 20" is biased in such a manner that the limiter elements 25" and 26" contact one another. The stress state of the first resilient element 21' is accordingly identical with the stress state which is realized in the equilibrium position of the load carrier 2. The stress state of the first resilient element 21" of the connecting element 20" is accordingly identical with the stress state of the first resilient element 21 of the connecting element 20.

In the situation illustrated in FIG. 2, the connecting element 20' is relieved in such a manner that the compressive stress of the first resilient element 21' is sufficient to keep the limiter elements 26' and 27' at a spacing in such a manner that they do not contact one another. In the present case the instantaneous longitudinal extent of the first resilient element 21' in the direction of the guide 17' is increased compared with the longitudinal extent associated with the equilibrium position of the load carrier 2. In a corresponding manner the compressive stress which the first resilient element 21' of the connecting element 20' has is smaller than the compressive stress which the first resilient element 21 or the first resilient element 21" has. In the present case the connecting element 20' is stressed in such a manner that the guide element 11' acts on the guide surface 6' with a finite force.

The first resilient elements 21, 21' and 21" are respectively realized by helical springs, the coils of which are in each instance laid around one of the guides 17, 17' and 17". The second resilient elements 22, 22' and 22" there are provided, for example, as solid bodies of a cellular or a mixed-cellular polyurethane elastomer which is dimensioned in such a manner that the bodies fill out a space between the counter-bearing 25 and the limiter element 26, between the counter-bearing 25' and the limiter element 26' and between the counter-bearing 25" and the limiter element 26", respectively.

Figure 3A:
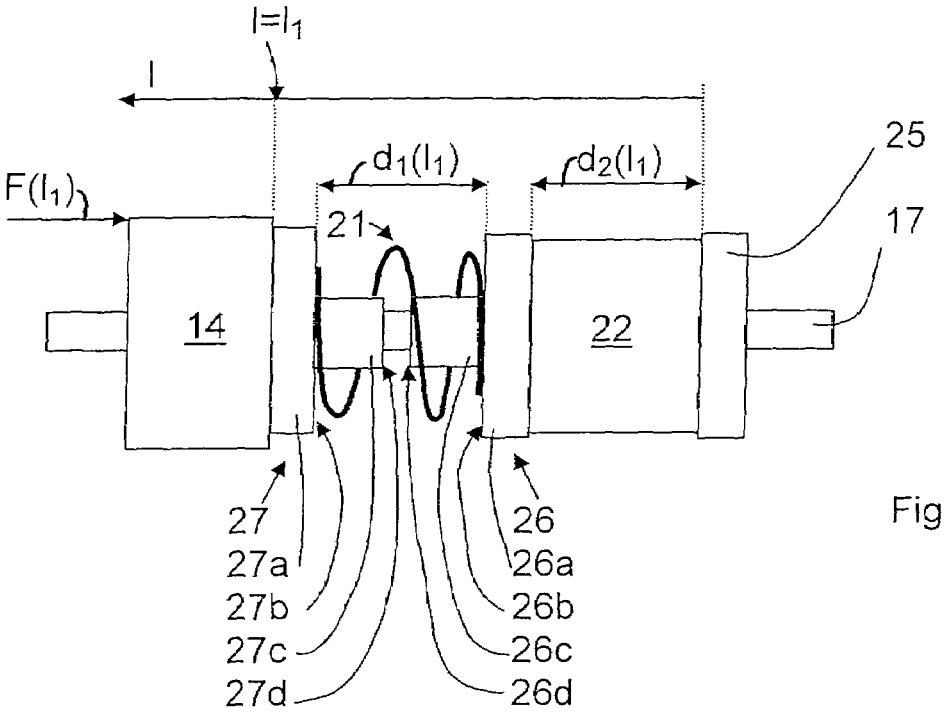
FIGS. 3A-C are schematic views of a connecting element of the guide device shown in FIG. 2, at different settings of the guide element.
Figure 3B:
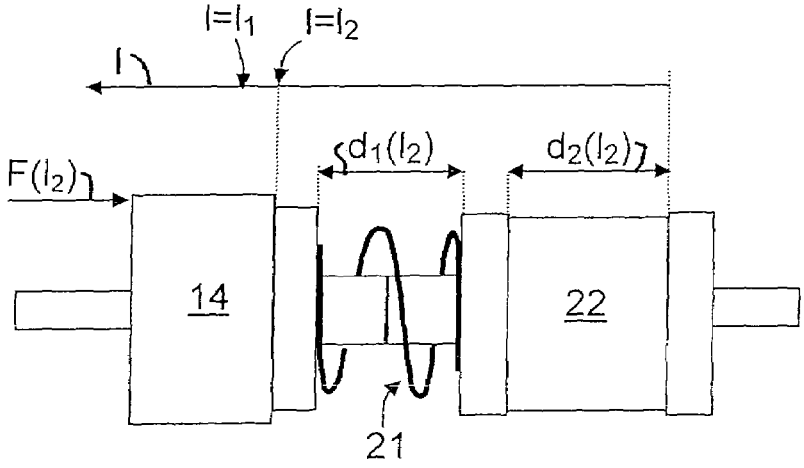
Figure 3C:
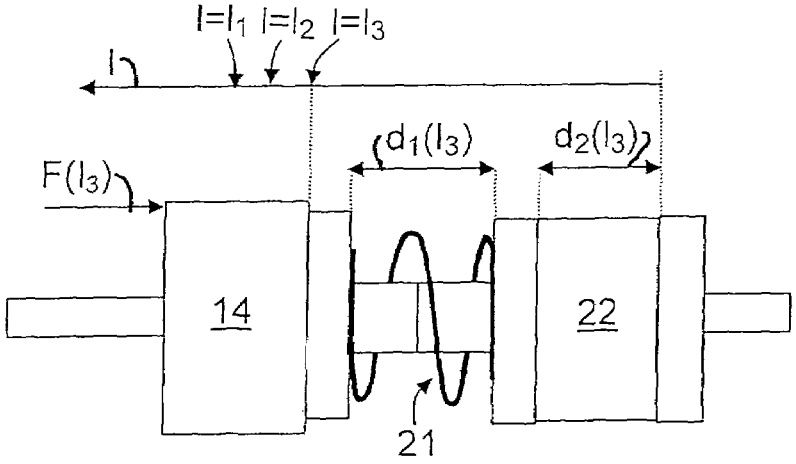

FIGS. 3A-C each show a portion of the guide device 10 in the region of the connecting element 20. FIGS. 3A-C illustrate the connecting element 20 in three different states which are respectively characterized by different settings of the lever 14 relative to the counter-bearing 25. Each of these states accordingly corresponds with another position of the guide element 11 relative to the load carrier 2. For the sake of simplicity, the guide element 11, the rotational axle 12 and the support 16 are not illustrated.

The limiter elements 26, 27 each comprise two cylindrical longitudinal sections 26*a* and 26*c* or 27*a* and 27*c*. The outer diameters of the longitudinal sections 26*c* and 27*c* are in each instance smaller than the outer diameters of the longitudinal sections 26*a* and 27*a*. The limiter elements are arranged in such a manner that the longitudinal sections 26*c* and 27*c* face one another in the direction of the guide 17. The longitudinal sections 26*c* and 27*c* each have a planar contact surface 26*d* or 27*d* at the end remote from the longitudinal sections 26*a* or 27*a*, respectively. When the limiter elements 26 and 27 are brought into contact with one another by an appropriate movement of the lever 14, they contact one another at the contact surfaces 26*d* and 27*d*. A uniform, mechanically positive force transmission between the limiter elements 26 and 27 is thereby achieved.

The longitudinal extent of the length sections 26*c* and 27*c* in the direction of the guide 17 accordingly defines the minimum spacing which the longitudinal sections 26*a* and 27*a* can adopt relative to one another. The limiter elements 26 and 27 each have a respective contact surface 26*b* or 27*b* for the first resilient element 21. The first resilient element 21 bears against the contact surfaces 26*b* and 27*b* so that the first resilient element 21 can be deformed by variation in the spacing between the contact surfaces 26*b* and 27*b* and thus placed under a compressive stress in the direction of the guide 17.

In FIGS. 3A-C the respective position of the guide element 11 relative to the load carrier 2 is characterized by a co-ordinate "l" which indicates the spacing between the lever 14 and the counter-bearing 25 measured along the guide 17.

A force "F" transmitted by means of the lever 14 along the guide 17 to the connecting element 20 depends on the position of the load carrier and is denoted in the following by "F(l)". The spacing between the contact surfaces 26*b* and 27*b* corresponds with the respective length extent of the first resilient element 21 and is denoted by "$d_1(l)$". Correspondingly, "$d_2(l)$" indicates the instantaneous spacing between the limiter element 26 and the counter-bearing 25 and thus the length extent of the second resilient element 22 in the direction of the guide 17.

In the case of FIG. 3A a position with "$l=l_1$" is selected in which the limiter elements 26 and 27 do not contact the contact surfaces 26*d* and 27*d*. If—starting from this position—the load carrier is moved into a position with "$l<l_1$", then not only "$d_1$", but also "$d_2$" are reduced and thus the first resilient element 21 and the second resilient element 22 are deformed in such a manner that the compressive stresses in the first resilient element 21 and in the second resilient element 22 and thus the force "F(l)" are constantly increased. This applies at least as long as the force "F" is increased in such a manner, and the co-ordinate "l" is reduced in such a manner, that the limiter elements 26 and 27 come into contact at the contact surfaces 26*d* and 27*d*. It is assumed that this situation is achieved for the position "$l=l_2$". This situation is illustrated in FIG. 3B.

In the case of FIG. 3C, "$l=l_3<l_2$" is assumed. By comparison with the situation according to FIG. 3B, the force "F" is increased and the second resilient element 22 is compressed to substantial extent in the direction of the guide 17, whilst the longitudinal extent of the first resilient element 21 in the direction of the guide 17 is unchanged. Thus there applies: "$d_1(l_3)=d_1(l_2)$" and "$d_2(l_3)<d_2(l_2)$". The compressive stress which the second resilient element 22 absorbs is thus increased by comparison with the situation according to FIG. 3B, whereas the compressive stress which the first resilient 21 absorbs is unchanged.

Accordingly, distinction is made between a first range (denoted by "A" in the following) of positions with "$l>l_2$" and a second range (denoted by "B" in the following) of positions with "$l<l_2$". If the guide element 11 is moved between different positions in the range "A", then not only the first resilient element 21, but also the second resilient element 22 are deformed and the respective compressive stresses, which the resilient elements 21 and 22 absorb, are changed. If, there against, the guide element 11 is moved between different positions in the range "B", then merely the second resilient element 22 is deformed and the compressive stress, which the second resilient element 22 absorbs, is changed.

The above considerations with respect to the connecting element 22 can be transferred in analogous manner to the connecting elements 20' and 20".

Figure 4A:
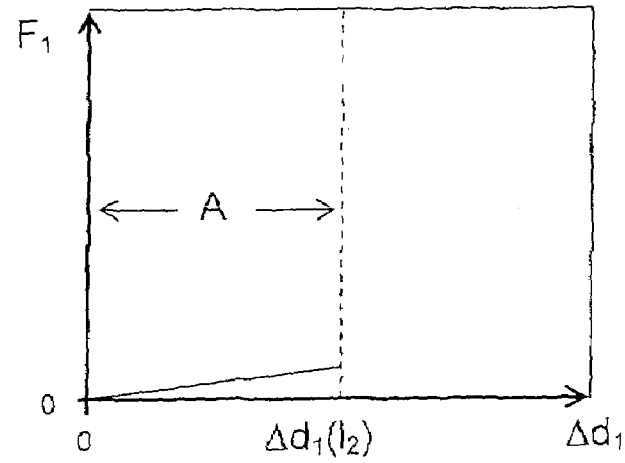
FIG. 4A is a plot of a force, which acts at a first resilient element of the connecting element of FIGS. 3A-C, as a function of a change in length of the first resilient element.
Figure 4B:
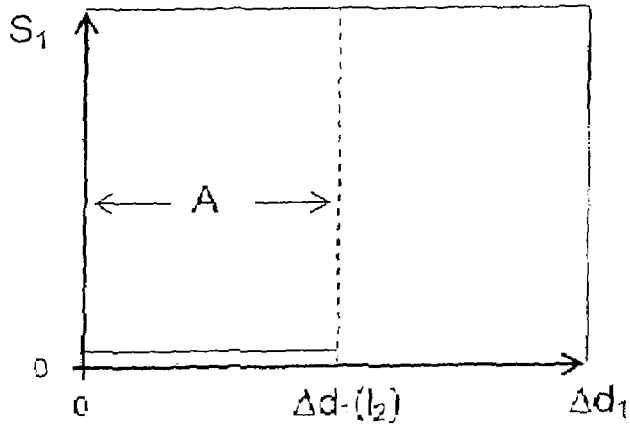
FIG. 4B is a plot of the stiffness of the first resilient element according to FIG. 4A as a function of a change in length of the first resilient element.
Figure 5:
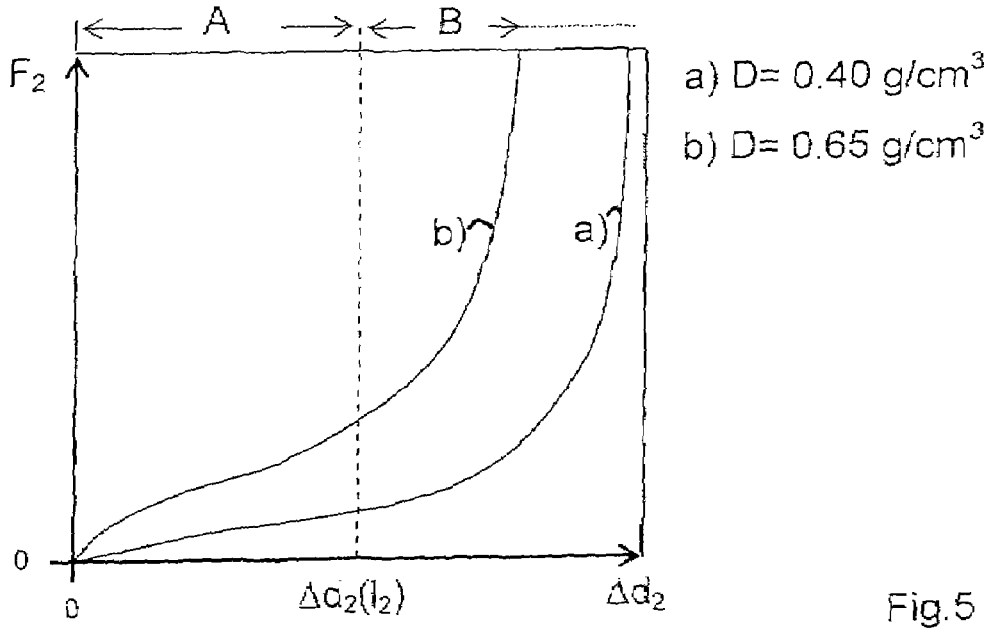
FIG. 5 is a plot of a force, which acts at a second resilient element of the connecting element of FIGS. 3A-C, as a function of a change in length of the second resilient element.

The behavior of the guide device depends substantially on how a transition between the ranges "A" and "B" is effected. FIGS. 4 to 6 clarify the optimization of the guide device with respect to the travel behavior of the load carrier 2.

It is assumed that the first resilient elements 21, 21' and 21" are respective springs, the longitudinal extent of which varies linearly in each instance with a force "$F_1$" acting in their longitudinal direction. FIG. 4A shows qualitatively a plot of the force "$F_1$" as a function of the change "$\Delta d_1(l) = d_{10} - d_1(l)$" of the longitudinal extent of the first resilient element 21, 21' or 21". The magnitude "$d_{10}$" in that case indicates the longitudinal extent of the first resilient element 21, 21' or 21" for the case that the resilient element is completely relieved, i.e. "$F_1=0$". A stiffness "$S_1$" of the first resilient element 21, 21' or 21" is illustrated (qualitatively) in FIG. 4B. The stiffness "$S_1$" is in that case determined as the gradient of the force "$F_1$" as a function of the change "$\Delta d_1(l)$". In FIGS. 4A-B, the force "$F_1$" and the stiffness "$S_1$" are indicated only for the positions of the guide elements 11, 11' and 11", which are attributed to the range "A". The stiffness "$S_1$" is constant in the range "A".

It is assumed that the second resilient element is a solid body of an elastomer, for example of polymers or cellular or mixed-cellular polyurethane family. There can be formed on the basis of polyurethanes, as is known, a number of different elastomers, the resilient characteristics of which vary over a comparatively large range and can be selectively influenced by means of different parameters.

FIG. 5 qualitatively shows the course of a force "$F_2$", which acts on the second resilient element 22 along the guide 17, as a function of the change "$\Delta d_2(l) = d_{20} - d_2(l)$" of the longitudinal extent of the second resilient element 22, 22' or 22" for different elastomers which are attributed to the family of mixed cellular polyurethanes. The magnitude "$d_{20}$" in that case indicates the longitudinal extent of the second resilient element 22, 22' or 22" for the case that the resilient element is completely relieved, i.e. "$F_2=0$". A curve "a)" in FIG. 5 is representative of, for example, an elastomer of polyurethane with a density "$D=0.4$ g/cm$^3$" and a curve "b)" is representative of an elastomer of polyurethane with a density "$D=0.65$ g/cm$^3$". It is relevant for the illustrated examples that "$F_2$" increases non-linearly with the change "$\Delta d_2(l)$", wherein the respective course of the force "$F_2$" and, in particular, the magnitude of the non-linearity depends substantially on the material employed, but also on the density thereof and the shape of the second resilient element 22, 22' or 22".

A stiffness "$S_2$" of the second resilient element 22, 22' or 22" is in that case determined in each instance as the gradient of the force "$F_2$" according to FIG. 5 as a function of the change "$\Delta d_2(l)$". As can be seen, the stiffness "$S_2$" for large (by comparison with "$d_{20}$") changes "$\Delta d_2(l)$" increases drastically for both examples illustrated in FIG. 5. For small (by comparison with "$d_{20}$") changes "$\Delta d_2(l)$" the course of the stiffness qualitatively depends on the kind or density of the elastomer employed. For example, in the case of the curve "a)" the stiffness "$S_2$" continuously decreases with increasing change "$\Delta d_2(l)$". In the case of the curve "b)", the stiffness "$S_2$" in the range of small changes "$\Delta d_2(l)$" with increasing change "$\Delta d_2(l)$" initially continuously decreases to a minimum value and drastically increases—similarly to the case with curve "a)"—with large (by comparison with "$d_{20}$") changes "$\Delta d_2(l)$". The latter shows that, depending on the selection of the elastomer that is used, the presetting of a suitable bias can be used for optimization of the resilient characteristics of the second resilient element 22, 22' or 22".

On the basis of the curve for "$F_1$" as a function of the change "$\Delta d_1(l)$" and the curve for "$F_2$" as a function of the change "$\Delta d_2(l)$" there can be determined on each occasion the force "F" which is needed in order to change the longitudinal extent of one of the connecting elements 20, 20' and 20" by a predetermined distance "$\Delta l$". An overall stiffness "S" of the connecting elements—mathematically defined as a first derivative of the force "F" with respect to "$\Delta l$"—can be ascertained each time from the course of the force "F" as a function of "Al". The optimization of the course of the force "F" as a function of "$\Delta l$" is discussed in the following.

In the case of the design of the guide device 10, for example with respect to optimization of travel comfort (which can be characterized on the basis of, for example, the intensity of the vibrations produced during travel of the load carrier), different optimization criteria can be taken into consideration. These optimization criteria determine, in particular, the selection of the first resilient elements 21, 21' and 21" and the second resilient elements 22, 22' and 22".

Different boundary conditions play a role, for example:

a) The maximum distance by which the load carrier 2 may be deflected out of its equilibrium position transversely to the guide surfaces 6, 6' and 6" is usually limited, due to the construction of the elevator installation, and in the case of typical elevator installations lies in the region<10 mm.

b) The mean value for the force by which the guide elements 11, 11' and 11" act on the guide surfaces in the equilibrium position of the load carrier should not be too large so as not to damage the guide elements or elastically and/or plastically deform the guide elements. Guide elements which are disposed in contact with a guide surface and are elastically and/or plastically deformed under the influence of a force oriented onto the guide surface (for example, rollers which have at the circumference thereof a deformable coating disposed in contact with the guide surface) can give off disturbing vibrations during movement of the load carrier along the guide surface. Thus, through limitation of the mean value for the force by which the guide elements 11, 11' and 11" act on the guide surfaces an adequate service life of the guide elements can be guaranteed and unnecessary disturbing vibrations can be minimized. This criterion establishes an upper limit for the maximum bias which the connecting elements 20, 20' and 20" may have when the load carrier 2 adopts an equilibrium position with respect to the guide rails 5.

c) Different constructional and operational parameters of the elevator installation 1 determine the maximum values for the forces which are responsible for deflection of the load carrier 2 out of its equilibrium position in operation of the elevator installation. These maximum values define an upper limit value "$F_{max}$" for the forces which have to be absorbed by the connecting elements in the extreme case.

These boundary conditions define the framework for an optimum design of the first resilient elements 21, 21' and 21" and of the second resilient elements 22, 22' and 22".

For the optimization, the invention demonstrates the following possibilities:

(i) The non-linearity of the force "$F_2$" as a function of the change "$\Delta d_2(l)=d_{20}-d_2(l)$" of the longitudinal extent of the second resilient elements 22, 22' and 22" should not be too large. The above-mentioned boundary condition a) for the maximum distance by which the load carrier 2 may be deflected out of its equilibrium position also defines a maximum permissible limit value for "$\Delta d_2$" which may not be exceeded. The non-linearity of the force "$F_2$" as a function of the change "$\Delta d_2(l)$" should not be too large for large values of "$\Delta d_2$" which go close to this boundary value for "$\Delta d_2$". Inevitable tolerances in the production, assembly or adjustment of components of the guide device 10 would otherwise lead to changes in the characteristic of the connecting elements 20, 20' and 20" which could be controlled only with difficulty. The more strongly pronounced the non-linearity of the force "$F_2$", the more difficult it is to control maintenance of the above boundary condition c) for the upper limit value for the forces which have to be accepted by the connecting elements in the extreme case. In the case of deficient control of the tolerances, the force "F" which acts on the connecting element 20, 20' or 20" could exceed the upper limit value "$F_{max}$" with the consequence that the connecting element is overloaded or even damaged. This criterion defines a boundary for the selection of a suitable elastomer (see FIG. 5).

(ii) The characteristics of the first resilient elements 21, 21' and 21" and the second resilient elements 22, 22' and 22" can be matched to one another in such a manner that for each connecting element 20, 20' or 20" the overall stiffness "S" has a substantially constant course at a transition from the positional range "A" to the positional range "B". It is thereby achieved that the transition from the positional range "A" to the positional range "B" takes place without abrupt changes in the overall stiffness "S".

The following options are available for optimization according to criterion (ii):

Various elastomers are available as material for the second resilient element 22, 22' or 22" and the external dimensions of the second resilient element 22, 22' or 22" can be varied, for example the longitudinal extent in the direction of the guide 17, 17' or 17" and the cross-sectional area transverse to the guide 17, 17' or 17".

The stiffness "$S_1$" for the first resilient element 21, 21' or 21" can be predetermined.

The connecting elements 20, 20' and 20" can be biased for the case that the load carrier 2 adopts an equilibrium position with respect to the guide rails 5.

The bias determines the 'working point' of the guide elements 11, 11' and 11", i.e. it establishes which position the respective guide elements 11, 11' and 11" adopt when the load carrier 2 is disposed in its equilibrium position with respect to the guide rails 5. The working point can in that case lie in the range "A", the range "B" or in the transition between the ranges "A" and "B". In addition, this bias influences the stiffness "$S_2$" of the second resilient elements at the working point (see FIG. 5). This working point must be compatible with the above boundary conditions a), b) and c).

Figure 6A:
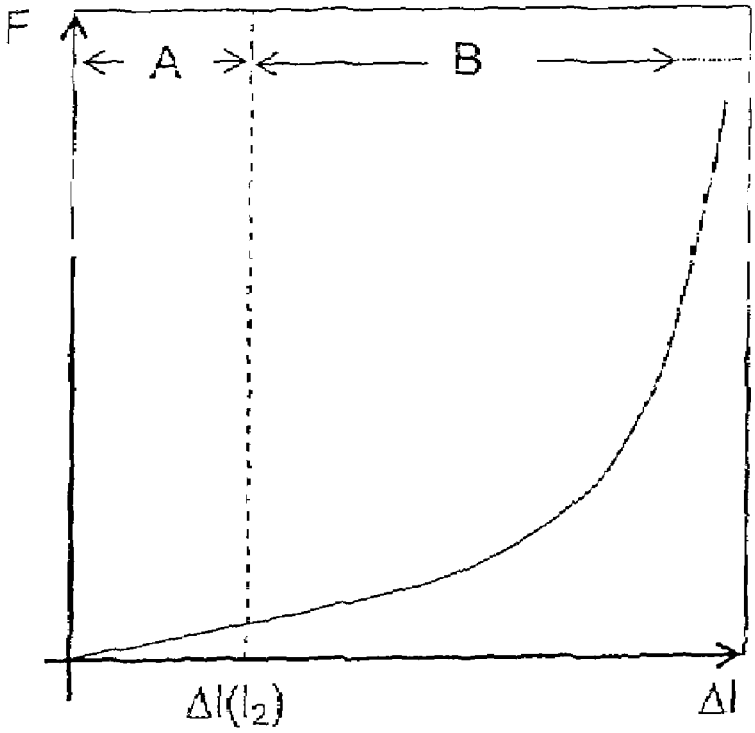
FIG. 6A is a plot of the force, which acts on the connecting element, as a function of a change in length of the connecting element, for resilient characteristics, which are optimally matched to one another, of the first and the second resilient element.
Figure 6B:
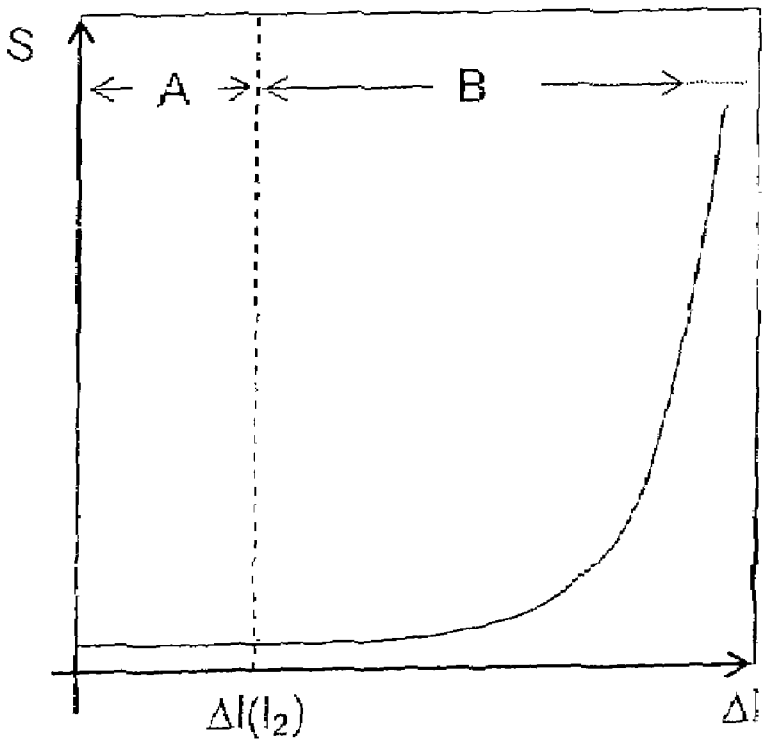
FIG. 6B is a plot of overall stiffness of the connecting element according to FIG. 6A as a function of a change in length of the connecting element.

An example for an optimization according to criterion (ii) is illustrated in FIGS. 6A-B. FIG. 6A shows in qualitative terms the course of the force "F" as a function of the change "$\beta l=l_0-l$" of the co-ordinate "l" for the position of the guide element 11, 11' or 11" (with respect to the position "$l=l_0$", in which the first resilient element and the second resilient element are relieved and for which "F=0" is realized) for a form of embodiment of the connecting element 20, 20' or 20" with the following characteristics:

The first resilient element has a stiffness "$S_1$=8N/mm", the second resilient element consists of a polyurethane elastomer with the density "D=0.4 g/cm$^3$" and has a force-elongation characteristic according to the curve "a)" for the force "$F_2$" in FIG. 5 and a longitudinal extent "$d_{20}$=21 mm".

FIG. 6B shows the overall stiffness "S" as a function of the change "Δl" of the position of the guide element 11, 11' or 11". The overall stiffness "S" is calculated from the course of the force "F" as a function of the change "Δl" of the position of the guide element 11, 11' or 11" according to FIG. 6A. The stiffness "S" in that case indicates each time the slope of the curve "F" for each change "Δl".

The vertical dashed lines in FIGS. 6A and 6B respectively mark the transition between the range "$A(l>l_2)$" and "$B(l<l_2)$". The vertical dashed lines in FIG. 5 mark the transition between the range "$A(l>l_2)$" and "$B(l<l_2)$" in the case of the curve "a)". The parameter ranges "$\Delta d_1(l)$", "$\Delta d_2(l)$" and "Δl", which correspond with the ranges "A" and "B", are respectively illustrated in FIGS. 4 to 6 by double arrows. In that case an exact upper limit of the range "B" is not shown in each instance in FIGS. 4 to 6 (as is indicated by an extension of the double arrow, which is characterized by "B", by means of a dotted line to large values for "$\Delta d_1(l)$", "$\Delta d_2(l)$" and "Δl".

As FIG. 6B shows, in the present example a connecting element 20, 20' or 20" is realized, the stiffness of which increases as a function of the change "Δl". The overall stiffness "S" then exhibits, in particular, a constant course at a transition from the positional range "A" to the positional range "B". The magnitudes "$l_2$", "$\Delta d_1(l_2)$" and the cross-sectional area of the second resilient element 22, 22' or 22" transversely to the guide 17, 17' or 17" are correspondingly adapted in order to minimize a jump in the constancy of the overall stiffness "S" at the transition between the positional ranges "A" and "B" or to eliminate it.

A significant precondition for an optimization according to criterion (ii) is to be seen in that the stiffness "$S_2$" of the second resilient element 22, 22' or 22" varies over a large range when the second resilient element 22, 22' or 22" is placed under a compressive stress.

In the present case the bias of the connecting elements 20, 20' or 20" is so selected that the working point of each of the guide elements 11, 11' and 11" lies each time in the range "B" in the vicinity of the transition between the ranges "A" and "B". This form of embodiment of the connecting element 20, 20' or 20" is compatible with the operating conditions which are to be found in typical elevator installations. As was already explained, this selection of the working point is arbitrary. It is also conceivable to undertake an appropriate optimization according to the invention for a working point which lies in the range "A" or at the transition between the ranges "A" and "B". If the optimization in accordance with the invention of the connecting elements 20, 20' and 20" should be undertaken in such a manner that the working point of the guide elements 11, 11' and 11" lies in the range "A", then the limiter elements 26 and 27 or 26' and 27' or 26" and 27" should not contact one another when the load carrier 2 adopts an equilibrium position with respect to the guide surfaces (in departure from the situation illustrated in FIG. 2).

The examples of the embodiment illustrated in the foregoing can still be modified and/or supplemented in many ways within the scope of the present invention.

For example, the first resilient element does not necessarily have to be constructed as a helical spring. The first resilient element could equally be a solid body of an elastomer or another device with resilient properties. The first resilient element and the second resilient element also do not have to be of integral construction. It is also conceivable to compose the first resilient element and/or the second resilient element according to the invention from several (identical or different) resilient components selectably in serial and/or parallel arrangement.

The guide element could also be resiliently deformable, for example a roller with a resilient roller coating which is to be brought into contact with one of the guide surfaces. A slide element, which is to be brought into sliding contact with one of the guide surfaces, could also be provided as guide element.

In addition, the guide device could be equipped with an additional buffer element which limits the deflection of one of the guide elements out of the respective normal position to a maximum value and thus protects the connecting elements 20, 20' and 20" against overload.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A guide device for guidance of a load carrier of a elevator installation along at least one guide surface, the guide device having at least one guide element which is disposed in contact with the guide surface and which is connected with the load carrier for movement relative to the load carrier between different positions in first and second positional ranges, comprising:

a connecting element adapted to be connected between the load carrier and the at least one guide element, said connecting element including a first resilient element and a second resilient element arranged in series in such a manner that in the case of movement of the at least one guide element in the first positional range both said first and second resilient elements are deformed and in the case of movement of the at least one guide element in the second positional range exclusively said second resilient element is deformed;

wherein an overall stiffness characteristic of said connecting element is a function of the respective position of the at least one guide element and the overall stiffness characteristic is greater in the second positional range than in the first positional range; and wherein said second resilient element has a stiffness characteristic that increases in the case of a compression of said second resilient element in the second positional range and the overall stiffness of said at least one connecting element is substantially constant in the case of a transition of the at least one guide element between the first positional range and the second positional range.

2. The guide device according to claim 1 wherein said second resilient element has a solid body being dimensioned in dependence upon a stiffness characteristic of said first resilient element.

3. The guide device according to claim 1 wherein said first and second resilient elements exert a bias on the at least one guide element in a normal setting of the at least one guide element.

4. The guide device according to claim 1 wherein said second resilient element is formed from an elastomer material.

5. The guide device according to claim 4 wherein said elastomer material is a polyurethane material.

6. The guide device according to claim 1 wherein said connecting element includes a guide for at least one of said first and second resilient elements extending in a direction in which said connecting element is deformed in response to movement of the at least one guide element.

7. The guide device according to claim 1 wherein said first resilient element has a stiffness characteristic that is constant in the first positional range.

8. The guide device according to claim 1 wherein said first resilient element is a spring.

9. The guide device according to claim 1 including at least one limiter element limiting a deformation of said first resilient element to a predetermined dimension in the case of movement of the at least one guide element relative to the load carrier.

10. The guide device according to claim 1 wherein said connecting element is biased such that the at least one guide element in a normal setting relative to the load carrier adopts a position in the second positional range or in a transition between the first positional range and the second positional range.

11. The guide device according to claim 1 wherein said connecting element is biased such that the at least one guide element in a normal setting relative to the load carrier adopts a position in the first positional range.

12. The guide device according to claim 1 wherein the at least one guide element is a roller.

13. A guide device for guidance of a load carrier of a elevator installation along guide surfaces, the guide device having guide elements each disposed in contact with an associated one of the guide surfaces and which guide elements are connected with the load carrier for movement relative to the load carrier between different positions in first and second positional ranges, comprising:

first, second and third connecting elements adapted to be connected between the load carrier and an associated one of the guide elements, each said connecting element including a first resilient element and a second resilient element arranged in series in such a manner that in the case of movement of the associated guide element in the first positional range both said first and second resilient elements are deformed and in the case of movement of the associated one guide element in the second positional range exclusively said second resilient element is deformed;

wherein an overall stiffness characteristic of each of said connecting elements is a function of the respective position of the associated guide element and the overall stiffness characteristic is greater in the second positional range than in the first positional range; and wherein said second resilient element has a stiffness characteristic that increases in the case of a compression of said second resilient element in the second positional range and the overall stiffness of said connecting elements is substantially constant in the case of a transition of the associated guide element between the first positional range and the second positional range.

14. The guide device according to claim 13 wherein said second and third connecting elements bias the associated guide elements in opposite directions toward the associated guide surfaces.

15. The guide device according to claim 14 wherein said first connecting element biases the associated guide element toward the associated guide surface in a direction transverse to said opposite directions.

16. An elevator installation, comprising:

a load carrier movable along a plurality of guide surfaces;

a plurality of guide devices attached to said load carrier, each of said guide devices having at least one guide element disposed in contact with an associated one of the guide surfaces, each said guide element being connected with said load carrier for movement relative to said load carrier between different positions in first and second positional ranges;

each of said guide devices having a connecting element connected between said load carrier and said at least one guide element, each said connecting element including a first resilient element and a second resilient element arranged in series in such a manner that in the case of movement of said at least one guide element in the first positional range both said first and second resilient elements are deformed and in the case of movement of the at least one guide element in the second positional range exclusively said second resilient element is deformed;

wherein an overall stiffness characteristic of each of said connecting elements is a function of the respective position of said connected at least one guide element and the overall stiffness characteristic is greater in the second positional range than in the first positional range; and wherein said each of said second resilient elements has a stiffness characteristic that increases in the case of a compression of said second resilient element in the second positional range and the overall stiffness of each of said connecting elements is substantially constant in the case of a transition of said connected at least one guide element between the first positional range and the second positional range.

17. The elevator installation according to claim 16 wherein said load carrier is one of an elevator car and a counterweight.

18. The elevator installation according to claim 16 wherein one of the guide surfaces is formed on a rail and said load carrier has a pair of said guide devices attached thereto at spaced apart positions, each said guide device of said pair of guide devices having said at least one guide element disposed in contact with the one guide surface.

19. The elevator installation according to claim 16 wherein said guide surfaces are formed on a pair of rails along which said load carrier is movable.

* * * * *